US007883187B2

(12) United States Patent
Kawase

(10) Patent No.: US 7,883,187 B2
(45) Date of Patent: Feb. 8, 2011

(54) INK JET PRINTING APPARATUS

(75) Inventor: Junya Kawase, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 759 days.

(21) Appl. No.: 11/859,674

(22) Filed: Sep. 21, 2007

(65) Prior Publication Data

US 2008/0084463 A1 Apr. 10, 2008

(30) Foreign Application Priority Data

Oct. 6, 2006 (JP) ..... 2006-275306

(51) Int. Cl.
*B41J 2/175* (2006.01)

(52) U.S. Cl. ..... 347/84; 347/85; 347/89

(58) Field of Classification Search ..... 347/42, 347/65, 66, 84, 85, 89
See application file for complete search history.

(56) References Cited

U.S. PATENT DOCUMENTS 5,481,284 A * 1/1996 Kitahara et al. ..... 347/42
5,801,736 A * 9/1998 Ikkatai et al. ..... 347/86
5,956,062 A * 9/1999 Omata et al. ..... 347/89
6,254,218 B1 * 7/2001 Suzuki et al. ..... 347/43
6,315,402 B1 11/2001 Kawase ..... 347/85
6,328,426 B1 * 12/2001 Chahn et al. ..... 347/55
7,128,404 B2 * 10/2006 Kodama ..... 347/68

FOREIGN PATENT DOCUMENTS

JP 8-244250 9/1996
JP 2005-144919 6/2005

* cited by examiner

*Primary Examiner*—Anh T. N. Vo
(74) *Attorney, Agent, or Firm*—Fitzpatrick, Cella, Harper & Scinto

(57) ABSTRACT

In ink supply to a print head including: a common liquid chamber having an ink flow-in port into which the ink flows, and an ink flow-out port for returning the ink; discrete liquid chambers for each supplying the ink to a ejection port from the common liquid chamber; and gas-liquid separation members for each making only gas flow out from the discrete liquid chamber, wherein the pressure adjustment adjusts pressure relations of the pumps so that a relationship between a circulation pressurization pump, a circulation suction pump, and an air suction pump are provided.

7 Claims, 9 Drawing Sheets

INK JET PRINTING APPARATUS

BACKGROUND OF THE INVENTION

1. Field of the Invention

The present invention relates to an ink jet printing apparatus, more particularly, it relates to a full-line type ink jet printing apparatus.

2. Description of the Related Art

An ink jet printing apparatus performs printing by ejecting ink from ejection ports of a print head. As an energy generating element for generating energy for ejecting ink, an electro-machinery converter such as a piezoelectric element, and an element are employed that generates heat by irradiating electromagnetic waves such as a laser to eject ink droplets by the heat. Additionally, an electro-thermal converting element having a heat generation resistance for heating liquid is employed.

In particular, ejection ports can be arranged at high density in a print head for ejecting ink droplets with use of thermal energy, and therefore printing can be performed at high resolution.

The print head employing the electro-thermal converting element as the energy generating element can be easily downsized. Recently, advantages in IC technology and micro-processing technology can be used that remarkably advance technology and improve reliability in the semiconductor industry whereby high density mounting can be easily realized, and manufacturing costs can be saved. Additionally, in order to perform printing at higher definition, a method has been recently employed that creates the ejection ports for ejecting ink at high precision with use of photo-lithography technology.

In order to print a high definition image at higher speeds, a print head having a longer print width has been recently desired. Specifically, a print head having a length of 4 to 13 inch has been desired. As such a long print head, a print head, in which a plurality of print element boards and discrete filters corresponding thereto are arranged on a support substrate and an ink flow path is formed, is disclosed as prior art in Japanese Patent Laid-Open No. 2005-144919.

A common liquid chamber is provided on the ink flow path in the long print head, and discrete liquid chambers are included for storing ink to be supplied from the common liquid chamber to the print element boards each having a plurality of ejection port groups. Additionally, discrete filters and discrete gas-liquid separation members are arranged in the print head. In such a long print head, the ink is circulated and supplied from an ink flow-in port to an ink flow-out port through the common liquid chamber so as to be supplied to the common liquid chamber.

Such ink circulation and supply to the common liquid chamber is performed by simultaneous operation of a circulation pressurization pump and a circulation suction pump. For example, in Japanese Patent Laid-Open No. 8-244250 (1996), P1=P2 is disclosed as a relationship between P1 and P2, wherein P1 and P2 represent flow rates of the circulation pressurization pump and the circulation suction pump respectively. According to this relationship, the circulating ink is not discharged from the ejection port by pressure.

However, bubble to be generated in ink supply, etc., is accumulated in the discrete liquid chamber which is a space formed by being surrounded with each print element board and the discrete filters, the bubble causes clogging of the ejection port in printing, and the ink is not sufficiently ejected at times. Thus, the bubble is sometimes removed from the discrete liquid chamber by operating an air suction pump during the ink circulation. When the flow rates of the circulation pressurization pump and the circulation suction pump are kept the same, the ink in the common liquid chamber hardly flows into each discrete liquid chamber. In this case, operation for removing the bubble in the discrete liquid chamber cannot be performed, and clogging of the ejection port cannot be removed.

SUMMARY OF THE INVENTION

The present invention was made in order to solve the above problems, and aims at providing an ink jet printing apparatus capable of preventing ink from leaking from ejection ports and of improving a property for removing bubble in a liquid chamber of the head, the ink jet printing apparatus having a long print head.

The present invention provides an ink jet printing apparatus comprising: an ink tank for storing ink; a print head including a common liquid chamber having an ink flow-in port, into which the ink flows from the ink tank, and an ink flow-out port for returning the ink to the ink tank, discrete liquid chambers for each supplying the ink to a ejection port for ejecting the ink from the common liquid chamber, and gas-liquid separation members for each making only gas flow out from the discrete liquid chamber; a circulation pressurization pump supplying the ink to the common liquid chamber from the ink tank via a first ink path; a circulation suction pump returning the ink to the ink tank from the common liquid chamber via a second ink path; an air suction pump being connected to the common liquid chamber communication with the gas-liquid separation members; and a pressure adjustment unit for adjusting pressure relations of said pumps while the ink is supplied to the common liquid chamber.

According to the above constitution, the ink in the discrete liquid chamber is hardly discharged from the ejection port by pressure of the pump, and the bubble in the liquid chamber of the head can be removed in a state where the ink is prevented from leaking from the ejection port. Thus, an ink jet printing apparatus can be provided that suppresses the discharge amount of ink to be discharged and improves a bubble removal property.

Further features of the present invention will become apparent from the following description of exemplary embodiments (with reference to the attached drawings).

DESCRIPTION OF THE EMBODIMENTS

Embodiments of the present invention will be described in detail hereinafter with reference to the drawings.

First Embodiment

(1) Description of Print Head

Figure 1:
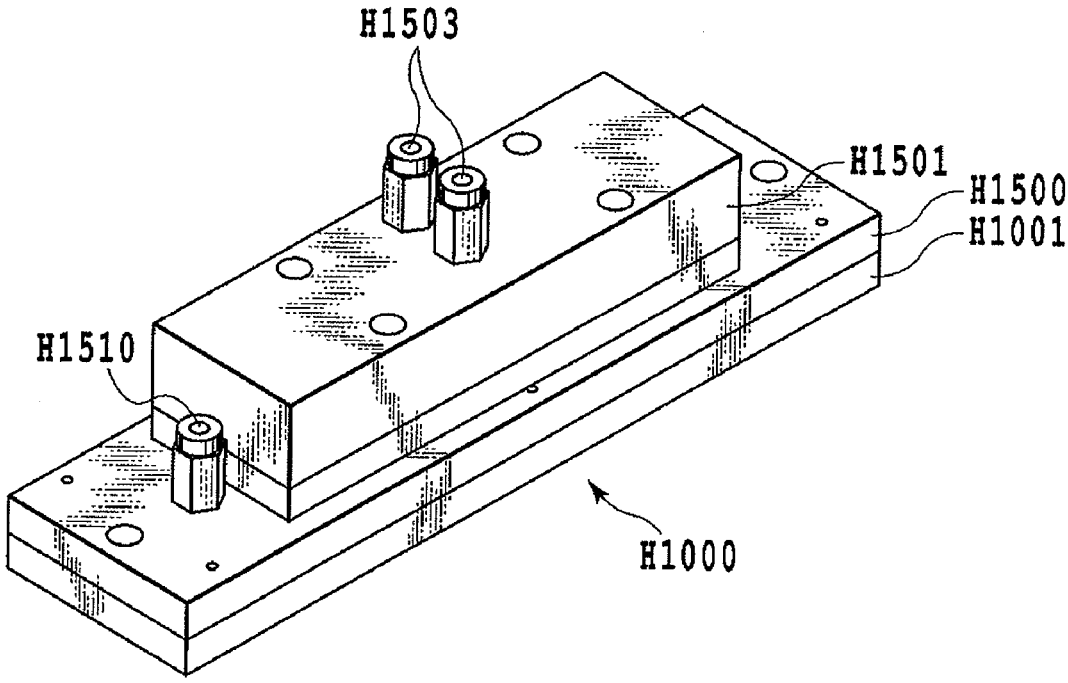
FIG. 1 is a perspective view of a print head of a first embodiment of the present invention.
Figure 2:
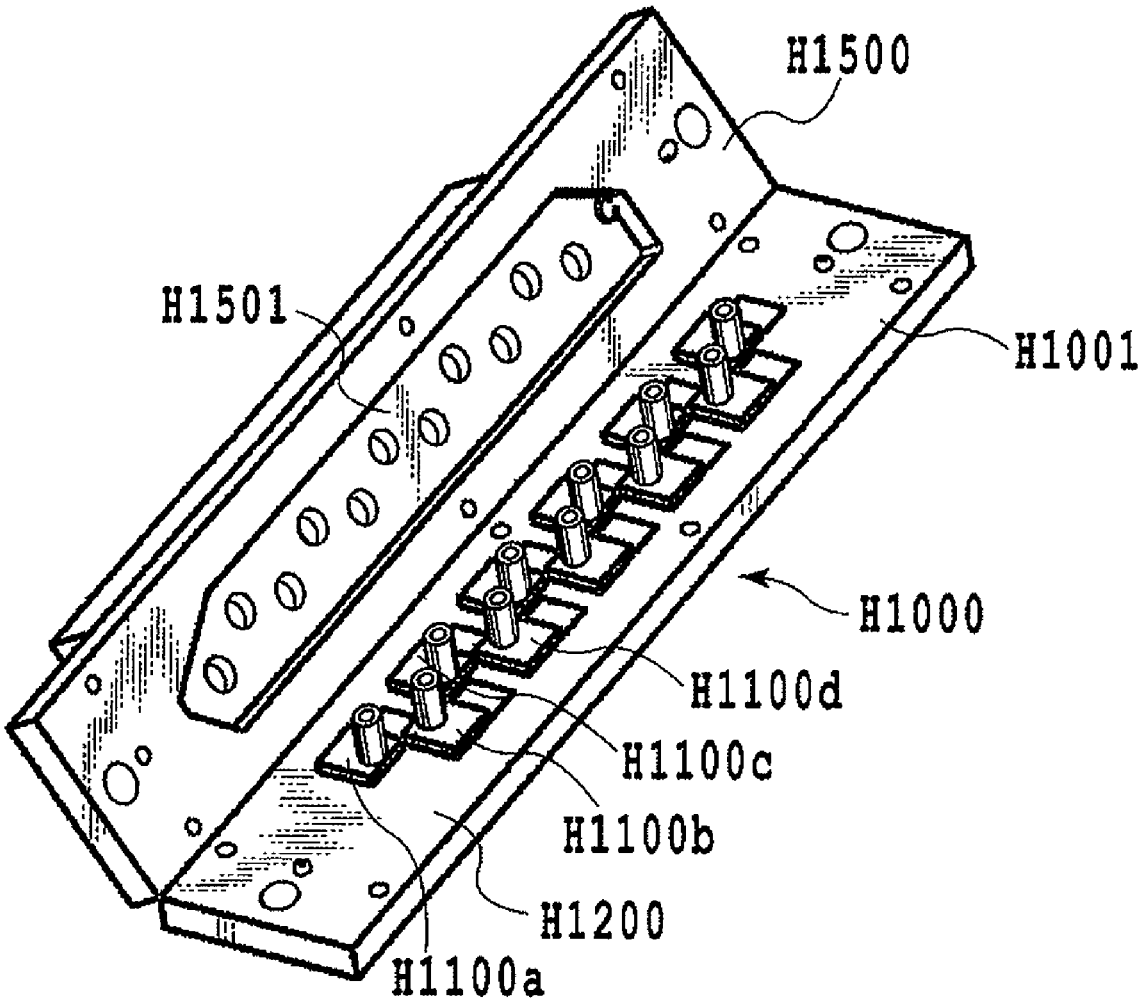
FIG. 2 is an analyzed perspective view of the print head.

FIGS. 1 and 2 are a perspective view and an analyzed perspective view of a print head of a first embodiment of the present invention respectively.

A print head H1000 is constituted by a print element unit H1001 and an ink supplying member H1500. FIG. 1 is a perspective view showing a state where the print element unit H1001 is connected to the ink supplying member H1500. Additionally, FIG. 2 is an analyzed perspective view showing a state where the print element unit H1001 and ink supplying member H1500 of the print head H1000 shown in FIG. 1 are opened.

The print element unit H1001 is connected to the ink supplying member H1500 by, for example, positioning and fixing them with each other with a screw, sealing the fixed part with sealant, etc., and sealing up a common liquid chamber H1501. As the sealant, sealant is desirable that has ink-proof capabilities, a hardening property at normal temperatures, and flexibility for withstanding a linear expansion difference between materials different from each other. The reference symbol H1510 denotes an ink flow-in port through which the ink flows into the common liquid chamber described below. The reference symbol H1511 denotes an ink flow-out port through which the ink flows out from the common liquid chamber.

As shown in FIG. 2, print element boards H1100 are arranged zigzag on a print element support plate H1200, and make wide printing of the same color possible. For example, four print element boards H1100*a*, H1100*b*, H1100*c*, and H1100*d* each having a nozzle group length of 1 inch+$\alpha$ are arranged zigzag, and make 4 inch width printing possible. The print element support plate H1200 is provided in the print element unit H1001. A power source and an electric wire board (flexible wire board) for transmitting an electric signal based on image information to the print element board are, from outside, adhered and fixed to the side, on which the print element boards H1100 are arranged, of the print element support plate H1200 (not shown).

The print element support plate H1200 is formed of, for example, alumina ($Al_2O_3$) having a thickness of 0.5 to 10 mm. However, a material of the print element support plate H1200 is not limited to alumina. The plate H1200 may be made of a material having a linear expansion rate equal to that of a material of the print element board H1100, and having a thermal conduction rate equal to or more than that of the material of board H1100. The following materials are applicable: silicon (Si); aluminum nitride (AlN); zirconia; silicon nitride ($Si_3N_4$); silicon carbide (SiC); molybdenum (Mo); and tungsten (W).

The ink supplying member H1500 has the common liquid chamber H1501, and is formed by, for example, resin molding. Additionally, the ink flow-in port H1510 and the ink flow-out port H1511 are provided in the ink supplying member H1500, and form into an entrance and an exit of ink to the common liquid chamber H1501 respectively.

As shown in FIG. 1, air flow-out ports H1503 are provided in an outer surface of the ink supplying member. A tube to be connected to an air suction pump described below is connected to the air flow-out ports H1503. Suction for a discrete liquid chamber H1203 can be realized by the air suction pump.

Figure 3:
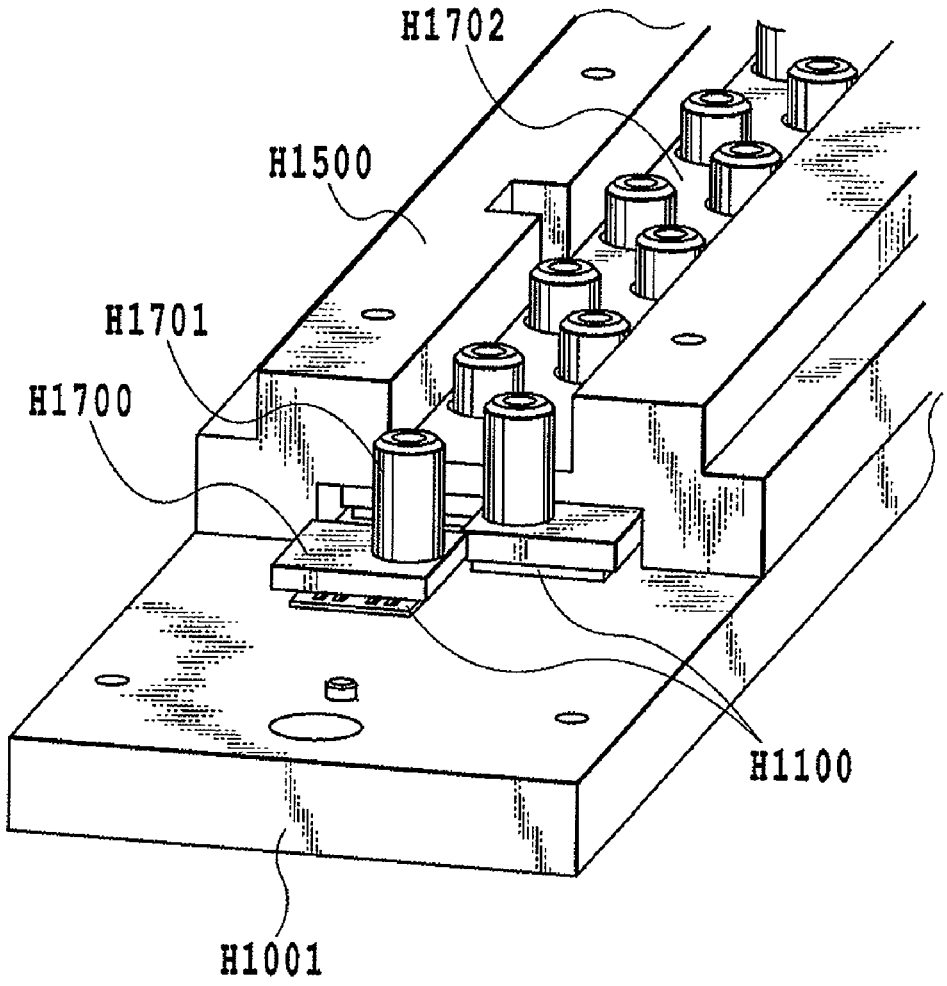
FIG. 3 is a cross sectional perspective view of the print head.
Figure 5:
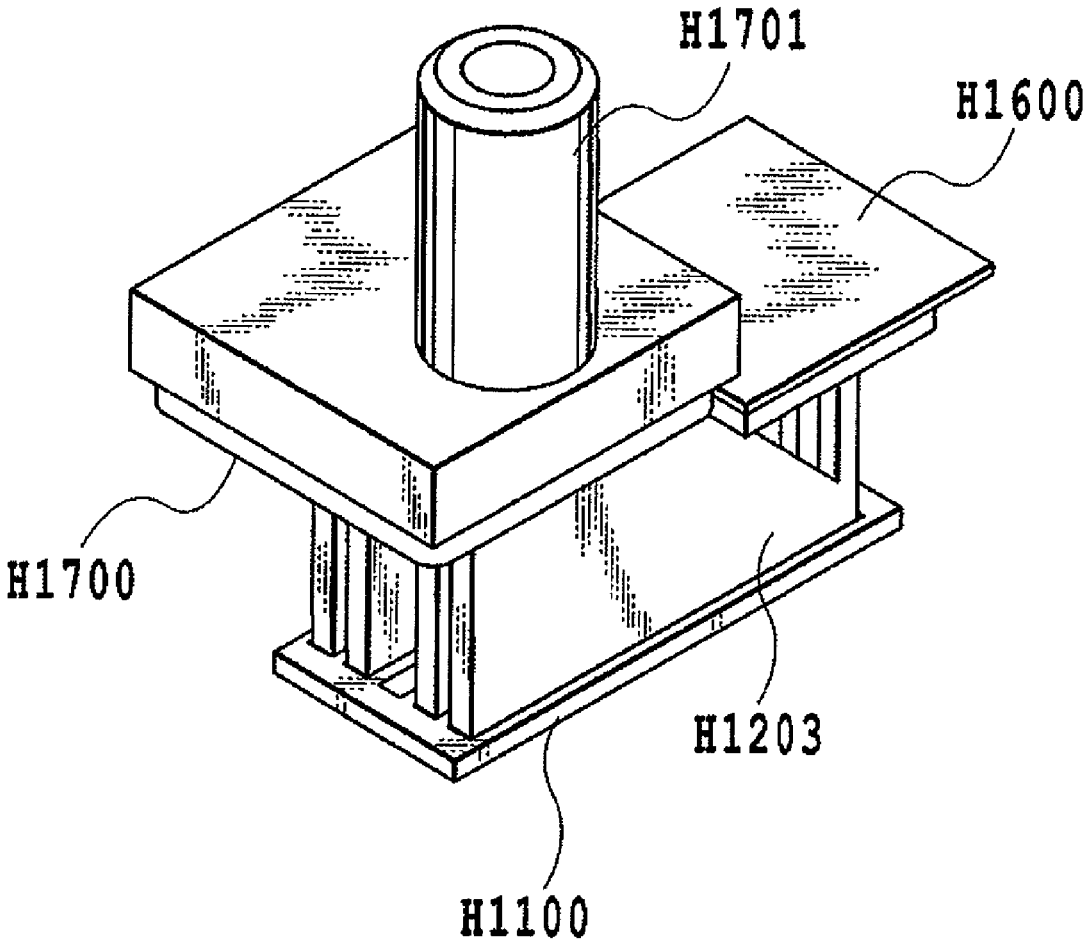
FIG. 5 is a partial perspective view of a print element unit of the first embodiment.

FIG. 3 is a perspective view showing a partial cross section of the print head H1000. The print element unit H1001 is connected to the ink supplying member H1500, and the plurality of print element boards H1100 arranged on the print element unit H1001 are provided in the ink supplying member H1500. As shown in FIG. 5, a gas-liquid separation member H1700, an air tube H1701 and an air decompression room H1702 are arranged on the print element board H1100.

Figure 4A:
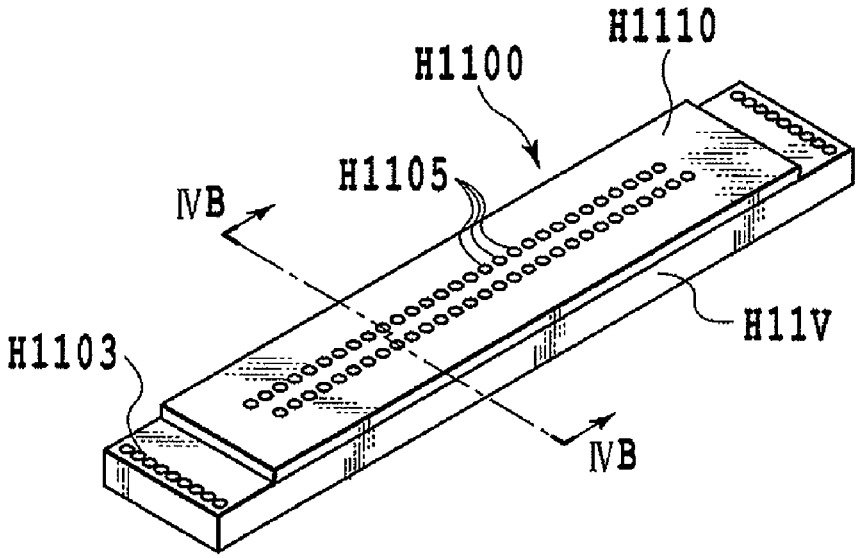
FIG. 4A is a perspective view of a print element board of the print head.
Figure 4B:
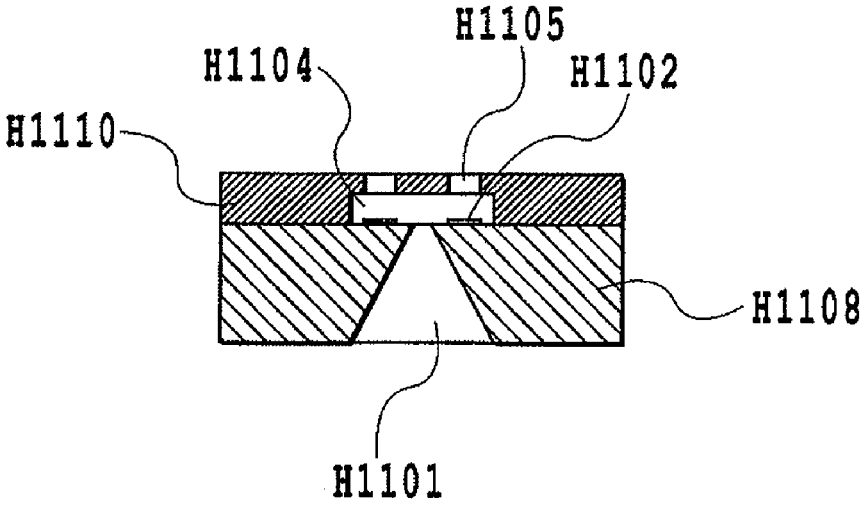
FIG. 4B is a cross sectional view taken along line IVB-IVB in FIG. 4A.

FIGS. 4A and 4B are views showing a constitution of the print element board H1100. Although four ejection port lines are provided in the print element board in the embodiment, the figures show, for simple description, a print element board having a single ejection port line. FIG. 4A shows the constitution of the print element board H1100, and FIG. 4B is a cross sectional view taken along broken line IVB-IVB in FIG. 4A. The reference symbol H1101 denotes an ink supply port, H1102 denotes an electric-thermal converting element, H1103 denotes an electrode, H1104 denotes an ink flow path, H1105 denotes an ejection port, and H1108 denotes a board respectively.

The substrate H1108 of the embodiment is formed by a thin member of silicon having a thickness of 0.5 to 1 mm. Additionally, the ink supply port H1101 constituted by a long groove-shaped through hole as an ink flow path is formed in the substrate H1108.

A line of the electric-thermal converting elements H1102 is arranged on each side of the ink supply port H1101 so that the elements H1102 of both the lines are arranged zigzag. The electric-thermal converting element H1102 and an electric wire are formed by member forming technology. Additionally, the electrode H1103 is provided for supplying power to the electric wire. The ink supply port H1101 is subjected to different directionality etching with use of a crystal direction of the silicon substrate H1108. When a wafer surface <100> has the crystal directionality <111> in a thickness direction, etching advances at an angle of about 54.7° by alkaline (KOH, TMAH, hydrazine or the like) difference directionality etching. This etching is performed so that a desired depth is obtained.

Additionally, a nozzle plate H1110 is provided on the silicon substrate H1108, and the ink flow path H1104, the ejection port H1105 and the like, which correspond to the electric-thermal converting element H1102, are formed by photolithography technology. Additionally, the ejection port H1105 is provided so as to be opposite to the electric-thermal converting element H1102, and bubble is generated by the electric-thermal converting element H1102 so that the ink supplied from the ink supply port H1101 is ejected.

The ink is supplied to each tip of the ejection ports through each discrete liquid chamber H1203 via a discrete filter H1600 arranged on the print element board side of the common liquid chamber H1501.

FIG. 5 is a partial perspective view of the print element unit H1001 including the discrete liquid chamber H1203. The print element unit H1001 has the print element boards H1100, the discrete filters H1600, the discrete gas-liquid separation members H1700 and the discrete liquid chambers H1203.

The discrete liquid chamber is formed slit-shaped, and a top of the liquid chamber is formed taper-shaped having an inclination. The print element board of the embodiment has four lines of the ejection ports, and is formed in a shape of four slit lines. A communication port for the discrete filter H1600 is arranged at the lower part of the taper-shaped discrete liquid chamber, and the gas-liquid separation member H1700 is arranged at the uppermost part of the taper. Additionally, the separation member air tube H1701 is arranged on the side of the gas-liquid separation member H1700 opposite from the discrete liquid chamber H1203. The air tubes H1701 are united in the air decompression room H1702, the inside of the tube is decompressed by a separation member suction pump, and the bubble in the discrete liquid chamber H1203 is discharged outward via the gas-liquid separation member H1700.

The ink flows into the discrete liquid chamber H1203 from the common liquid chamber H1501 through the discrete filter. Then, the ink in the discrete liquid chamber H1203 is supplied to the ink flow path H1104, which communicates with the ejection ports, via the ink supply port H1101 of the print element board H1100.

(2) Description of Ink Jet Printer

Figure 6:
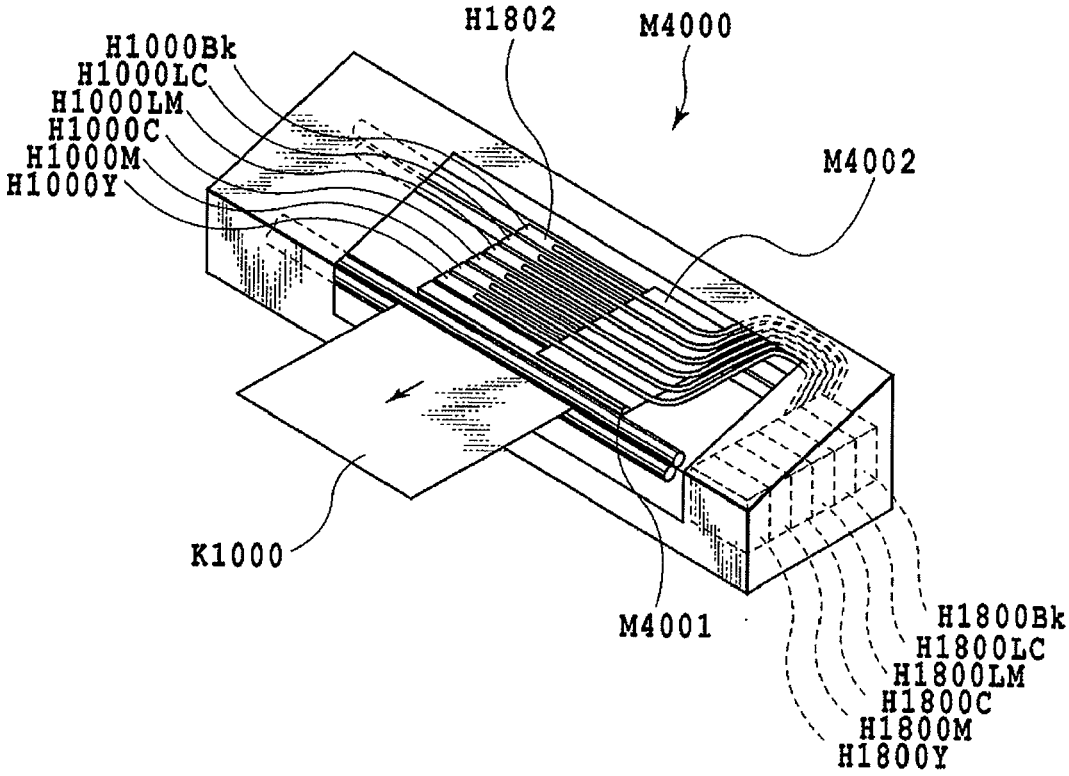
FIG. 6 shows an ink jet printing apparatus of the first embodiment.

FIG. 6 shows an ink jet printing apparatus M4000 according to the first embodiment of the present invention. In the embodiment, print heads for six colors are provided in accordance with printing of photograph image quality. A print head H1000Bk is a print head for black ink, a print head H1000C is a print head for cyan ink, a print head H1000M is a print head for magenta ink, and a print head H1000Y is a print head for yellow ink. A print head H1000LC is a print head for light cyan ink, and a print head H1000LM is a print head for light magenta ink. These print heads H1000 are fixed and supported by positioning means of a carriage M4001 mounted on a printing apparatus body M4000 and an electric contact point M4002.

These print heads are driven by a drive circuit so that printing to a print medium is performed. The printing apparatus of the embodiment is a full-line type printing apparatus in which the print head has a nozzle corresponding to the width of the print medium. The print head is fixed, the print medium is conveyed in a direction indicated by an arrow, and thus printing is performed.

Figure 7:
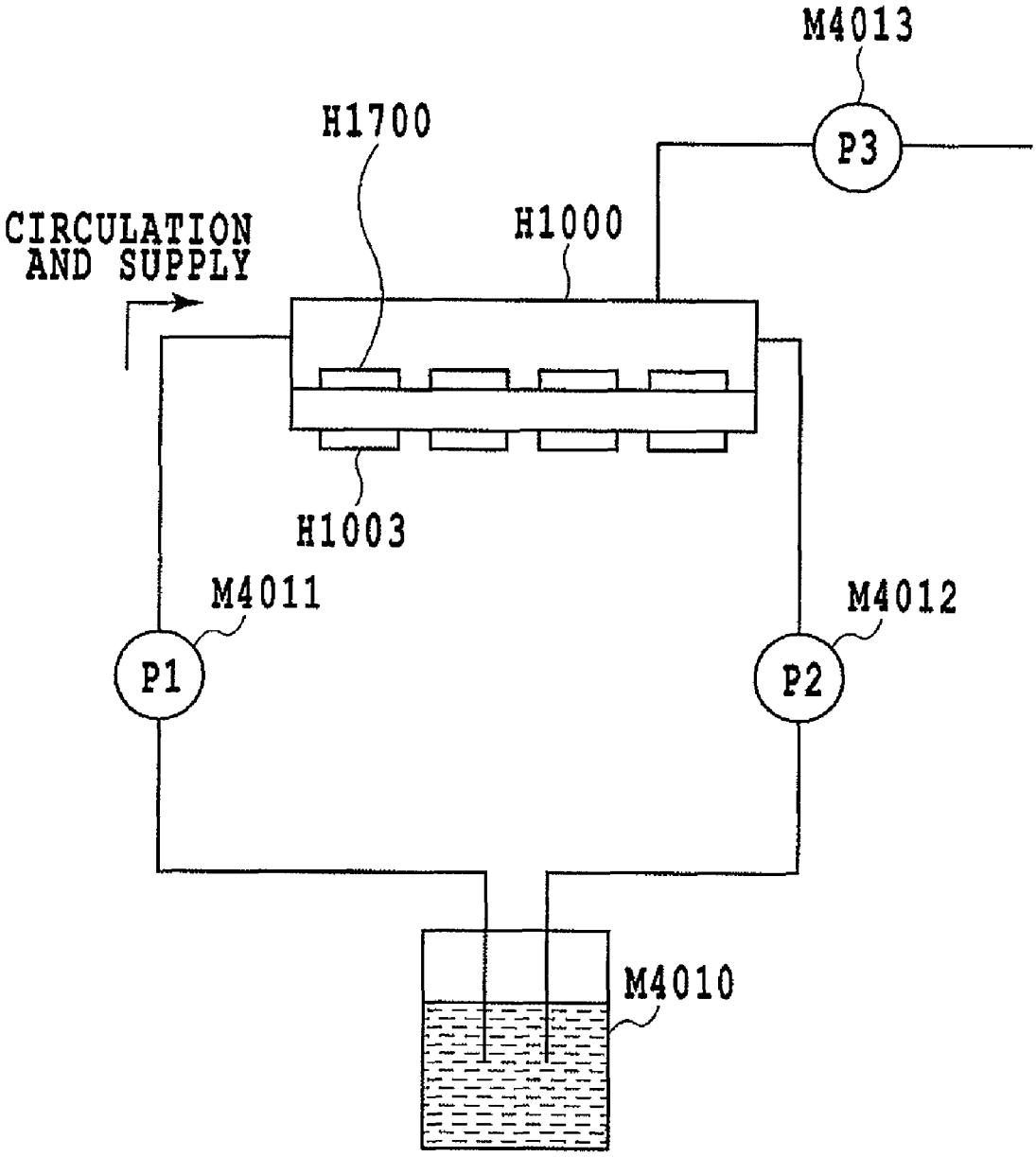
FIG. 7 is a schematic view of an ink supplying device of the ink jet printing apparatus.

FIG. 7 is a schematic view of an ink supplying device of the ink jet printing apparatus of the embodiment. The reference symbol M4010 denotes a sub-ink tank built in the body of the printer M4000, and the sub-ink tank is used so that ink in an ink cartridge is stored in the printer M4000.

The sub-ink tank M4010 is connected to the print head H1000 via two ink supply flow paths. A circulation pressurization pump M4011 for supplying the ink to the print head H1000 is arranged on side of the two ink flow paths, and a circulation suction pump M4012 for returning the ink to the sub-ink tank M4010 from the print head H1000 is arranged on the other side of the ink flow path.

Since there is a possibility that impurities precipitate due to long term contact of ink with the circulation pressurization pump M4011 and the circulation suction pump M4012, it is necessary to consider contact liquid property. Additionally, it is necessary to consider the cost of the pump device, controllability (normal/reverse rotation) of switching of an ink carriage direction or the like, scale of the pump device and the like. Although a tube pump for carrying the ink while drawing a rubber tube with a rotary body or the like is conceived, other kinds of pumps may be employed. Additionally, it is preferable that a material of the ink flowpath (tube) is selected in consideration of the contact liquid property to the ink, durability and a gas barrier property of the tube own or the like.

In the ink jet printing apparatus of the embodiment, the ink stored in the sub-ink tank M4010 flows into the ink flow-in port H1510 of the print head from the circulation pressurization pump M4011 to be supplied to the common liquid chamber H1501. Then, the ink passes through the ink flow-out port, and flows into the sub-ink tank M4010 through the suction pump M4012. Such a route is used for the ink supply path of the ink supplying device to be connected, and the ink is filled up and circulated to the common liquid chamber H1501 of the print head.

Additionally, the inside of the decompression room is decompressed by an air suction pump M4013, and air in the discrete liquid chamber H1203 is exhausted via the gas-liquid separation member H1700. Then, the ink in the common liquid chamber H1501 passes through the discrete liquid chamber H1203 via each discrete filter to be supplied to the ejection port H1105. Furthermore, a unit for adjusting the pressure of the pump in order to adjust the flow quantity of the pump is provided. The pressure adjusting unit may be provided inside each of the circulation pressurization pump M4011, the circulation suction pump M4012 and the air suction pump M4013 shown in FIG. 7. The pressure adjusting unit adjusts driving and the timing of each pump. The method of the adjustment of the pressure may be a method in which the adjustment is performed as needed while monitoring the flow quantity of each pump with sensors. As another method of the adjustment of the pressure, the pressure relations of each pump may be got preliminarily based on printing patterns. These pressures of each pump relations are stored in the information storing portion and the adjustment be performed with use of drive data saved on the substrate of the information storing portion. When the printing medium entire surface is printed by using ink, quantity of the ink which is necessary for printing increases. Then, it is necessary to supply a large quantity of ink. On the other hand, when the print medium is printed only letters, quantity of the ink which is necessary for a print decreases. Then, it should supply a small quantity of ink, and there may be small flow quantity of the ink which a pump carries away. In this case, one pressure adjustment for each pump may be provided inside of the printing apparatus showing in FIG. 6.

In ink filling action, first, the ink is circulated to the common liquid chamber H1501 by both the circulation pressurization pump M4011 and the circulation suction pump M4012 to be supplied (filling action A). Next, the air suction pump M4013 is activated via each separation member air tube H1701 arranged on each gas-liquid separation member H1700 side while the ink is circulated by simultaneously activating the circulation pressurization pump and the circulation suction pump (filling action B). The air in each discrete liquid chamber H1203 is sucked through the gas-liquid separation member H1700 so that a sequence operation is performed so that bubble is removed while the inside of each discrete liquid chamber H1203 is decompressed. As shown in FIG. 3, one end of the separation member air tube H1701 is arranged on the gas-liquid separation member H1700, and the other end thereof is opened to the air decompression room H1702. In the air decompression room, the separation member air tubes are united to form into a common air chamber. The air decompression room H1702 communicates with the air flow-out ports H1503, and the air in the discrete liquid chamber H1203 is removed from the air flow-out ports H1503 via the air suction pump M4013. Foam removal action indicates that the air in the discrete liquid chamber H1203 is thus removed from the air decompression room to the air suction pump side.

Here, the flow quantity of the pump is adjusted by the means to adjust the pressure for the relationship between flow rates in the filling action B set to $P1 \geqq P2+P3$, wherein P1, P2 and P3 represent the flow rates of the circulation pressurization pump M4011, circulation suction pump M4012 and air suction pump M4013 in the filling action B respectively. Thus, even if the filling action B is performed, the inside of each discrete liquid chamber H1203 is not decompressed, and filling the discrete liquid chamber H1203 with ink and the bubble removal action can be performed. The pressure relations that are the most favorable are P1=P2+P3. However, in consideration of the case that some errors occur to the flow quantity of each pump, it should adjust it to satisfy relations of P1≧P2+P3.

The ink is supplied to each discrete liquid chamber H1203 by the circulation pressurization pump and the circulation suction pump, and the air is removed by the air suction pump via the gas-liquid separation member. Thus, in the ink supplying device to the print head having a long joint, the ink can be supplied to each discrete liquid chamber H1203 with no generation of ink to be wasted by ink suction from the ejection port.

Second Embodiment

Figure 8:
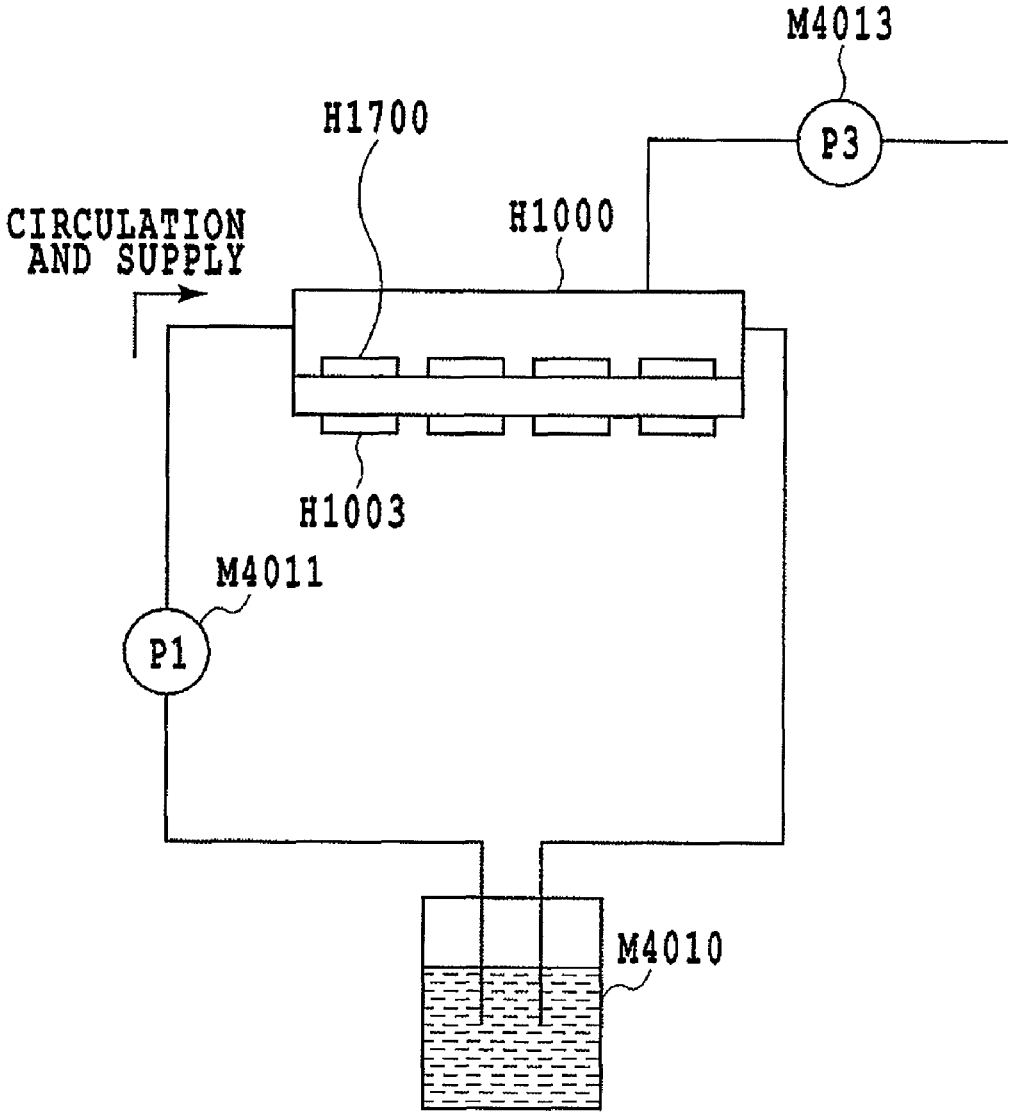
FIG. 8 is a schematic view of an ink supplying device of an ink jet printing apparatus of a second embodiment.

FIG. 8 is a schematic view of an ink supplying device of an ink jet printing apparatus of a second embodiment of the present invention.

In the embodiment, the circulation suction pump M4012 in the ink supplying device of the first embodiment is not used.

In the embodiment, circulation and supply of the ink into the common liquid chamber H1501 is performed by the circulation pressurization pump M4011, and simultaneously, the air suction pump M4013 is activated. As ink circulation and supply action, supplying ink/removing bubble to/from the discrete liquid chamber H1203 is performed. Here, the relationship between the flow rates P1 and P3 of the two pumps M4011 and M4013 is set to P1>P3. Thus, in removing the bubble from the discrete liquid chamber H1203, no external air is taken in from the ejection port, and the supplied ink is not discharged from the ejection port. Accordingly, no ink to be wasted from the ejection port is generated, and ink supply can be performed.

Third Embodiment

Figure 9:
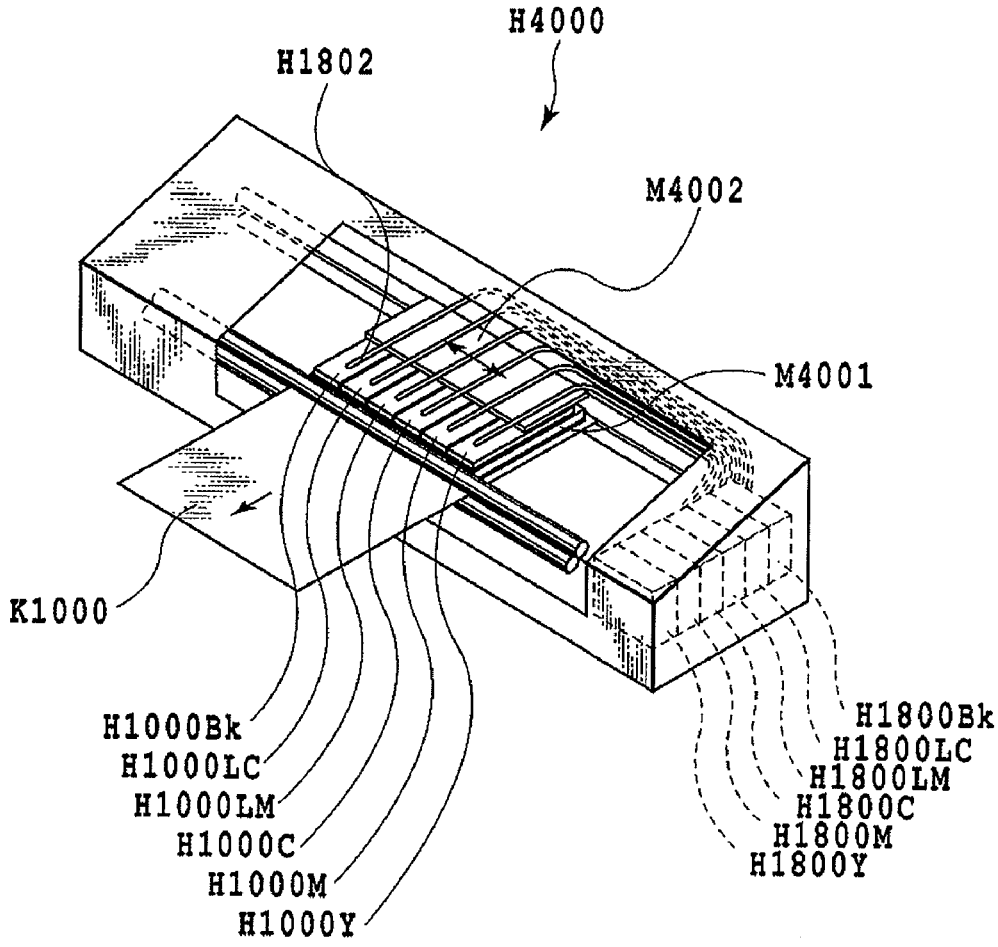
FIG. 9 shows an ink jet printing apparatus of a third embodiment.

Although the full-line type print head is described in the above embodiments, the present invention is not limited to such a print head. As shown in FIG. 9, a serial type print head used for serial method printing is applicable. In this case, as shown in FIG. 9, the circulation pressurization pump M4011 and the circulation suction pump M4012 are connected to a tube via which an ink tank H1800 is connected to the print head H1000. Additionally, the air suction pump M4013 for sucking the bubble in the discrete liquid chamber H1203 is connected to the print head H1000. The tube is shifted in accordance with a shift of the print head in a main scanning direction, and thus supplying ink/removing bubble to/from the discrete liquid chamber H1203 can be performed.

Further, the present invention is applicable to a fax machine having a copier and communication system, a word processor having a printing part, a multi-functional printer compounding the fax machine and the word processor, and the like, in addition to a normal printing apparatus. In particular, the present invention is applicable to a printing apparatus for printing at high speed and high image quality.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-275306, filed Oct. 6, 2006, which is hereby incorporated by reference herein in its entirety.

What is claimed is:

1. An ink jet printing apparatus comprising:

an ink tank for storing ink;

a print head including a common liquid chamber having an ink flow-in port, into which the ink flows from the ink tank, and an ink flow-out port for returning the ink to the ink tank, a discrete liquid chamber for supplying the ink to an ejection port for ejecting the ink from the common liquid chamber, and a gas-liquid separation member for making only gas flow out from the discrete liquid chamber;

a circulation pressurization pump supplying the ink to the common liquid chamber from the ink tank via a first ink path;

a circulation suction pump returning the ink to the ink tank from the common liquid chamber via a second ink path; and an air suction pump in communication with the discrete liquid chamber for sucking air from the discrete liquid chamber through the gas-liquid separation member;

wherein while the circulation pressurization pump and the circulation suction pump are driven to cause ink to circulate, the air suction pump is driven to suck air from the discrete liquid chamber.

2. The ink jet printing apparatus according to claim 1, wherein said pumps are driven so that a relationship between a flow rate P1 of the circulation pressurization pump, a flow rate P2 of the circulation suction pump, and a flow rate P3 of the air suction pump is defined as P1≧P2+P3.

3. The ink jet printing apparatus according to claim 1, wherein said pumps are driven so that a relationship between a flow rate P1 of the circulation pressurization pump, a flow rate P2 of the circulation suction pump, and a flow rate P3 of the air suction pump is defined as P1=P2+P3.

4. The ink jet printing apparatus according to claim 1, wherein the print head is a full-line type print head.

5. The ink jet printing apparatus according to claim 1, wherein the print head is a serial type print head.

6. An ink jet printing apparatus comprising:

an ink tank for storing ink;

a print head including a common liquid chamber having an ink flow-in port, into which the ink flows from the ink tank, and an ink flow-out port for returning the ink to the ink tank, a discrete liquid chamber for supplying the ink to an ejection port for ejecting the ink from the common liquid chamber, and a gas-liquid separation member for making only gas flow out from the discrete liquid chamber;

a circulation pressurization pump supplying the ink to the common liquid chamber from the ink tank via a first ink path; and an air suction pump in communication with the discrete liquid chamber for sucking air from the discrete liquid chamber through the gas-liquid separation member;

wherein while the circulation pressurization pump is driven to cause ink to circulate, the air suction pump is driven to suck air from the discrete liquid chamber.

7. The ink jet printing apparatus according to claim 6, wherein said pumps are driven so that a relationship between a flow rate P1 of the circulation pressurization pump and a flow rate P3 of the air suction pump is defined as P1>P3.

* * * * *